US005284019A

United States Patent [19]

Vdoviak

[11] Patent Number: 5,284,019

[45] Date of Patent: Feb. 8, 1994

[54] DOUBLE DOME, SINGLE ANULAR COMBUSTOR WITH DAISY MIXER

[75] Inventor: John W. Vdoviak, Marblehead, Mass.

[73] Assignee: The United States of America as represented by the Secretary of the Air Force, Washington, D.C.

[21] Appl. No.: 541,670

[22] Filed: Jun. 12, 1990

[51] Int. Cl.[5] ..... F02G 1/00

[52] U.S. Cl. ..... 60/733; 60/747

[58] Field of Search ..... 60/748, 733, 34–36, 60/746, 747

[56] References Cited

U.S. PATENT DOCUMENTS

| | | | |
|---|---|---|---|
| 3,306,333 | 2/1967 | Mock | 158/4 |
| 3,720,058 | 3/1973 | Collinson et al. | 60/39.74 R |
| 3,750,402 | 8/1973 | Vdoviak et al. | 60/261 |
| 3,811,277 | 5/1974 | Markowski | 60/733 |
| 3,872,664 | 3/1975 | Lohmann et al. | 60/746 |
| 4,077,206 | 3/1978 | Ayyagari | 60/264 |
| 4,173,118 | 11/1979 | Kawaguchi | 60/30.65 |
| 4,194,358 | 3/1980 | Stenger | 60/39.06 |
| 4,215,536 | 8/1980 | Rudolph | 60/262 |
| 4,237,694 | 12/1980 | Wood et al. | 60/738 |
| 4,246,758 | 1/1981 | Caruel et al. | 60/747 |
| 4,305,255 | 12/1981 | Davies et al. | 60/741 |
| 4,499,735 | 2/1985 | Moore et al. | 60/746 |
| 4,903,492 | 2/1990 | King | 60/733 |
| 4,991,398 | 2/1991 | Clark et al. | 60/748 |

*Primary Examiner*—Richard A. Bertsch
*Assistant Examiner*—Timothy S. Thorpe
*Attorney, Agent, or Firm*—Irwin P. Garfinkle; Donald J. Singer

[57] ABSTRACT

This disclosure describes a single shell, double dome combustor design configuration with the intermediate dividing wall between the two annuli removed, thereby reducing weight and cost, and improving durability. An annular daisy type mixer is positioned between the domes to improve the mixing of air and combustor gases prior to the exiting of the gases from the combustor to the turbine vanes. The daisy mixer positioned downstream of the domes to provides effective, low pressure loss mixing at a a controlled axial rate, by creating effective cross-flow barriers to avoid uncontrolled fuel/air ratio transfer between the inner and outer annuli, and thereby allows a concentric and controlled axial air admission in conjunction with the individual swirlers.

1 Claim, 1 Drawing Sheet

DOUBLE DOME, SINGLE ANULAR COMBUSTOR WITH DAISY MIXER

STATEMENT OF GOVERNMENT INTEREST

The invention described herein may be manufactured and used by or for the Government for governmental purposes without the payment of any royalty thereon.

BACKGROUND OF THE INVENTION

This invention is an improvement over the state of the art double dome combustor used in gas turbine engines.

Many gas turbine engines incorporate annular combustors to obtain the benefits of compactness, performance, weight, cost and durability. In those combustors of the single annular type where there is only a single annular array of fuel injectors and swirlers in the front section of the combustor, there is a relationship of dome height to combustor length (L/H) which largely governs the length of the combustor. The L/H ratio of modern combustor designs generally falls into the 2.0 to 2.5 range. The L/H ratio affects such characteristics as combustor exit temperature distribution including the circumferential integrated temperature profile and the pattern factor, and this is of particular importance to the stationary inlet turbine vane.

Generally speaking the exit temperature distribution is enhanced with higher L/H combustor ratios because longer lengths enhance mixing, and hence uniformity; however there are opposing consideration of engine weight, cost and durability which argue in favor of low L/H ratios, or shorter combustor designs. Shorter designs require less cooling air by virtue of the reduced surface area to be cooled, and are generally favored for engines which put a premium on high thrust to weight ratios.

It has been demonstrated that a double annular combustor can provide a number of benefits over the single annular combustor. Basically, a double annular combustor, also known as a double dome combustor, comprises two concentric single dome annular combustors. The benefits of the double dome combustor include:

1. Length. The combustors are shorter due to the potential of halving the L/H ratio.

2. Operability. By implementing two annular arrays of fuel injectors which is basic to the double annular design, the fuel may be staged so that the combustor operates with stability over a broader range of fuel/air ratios.

3. Emission Reduction. The short length and fuel staging flexibility allows better control for the reduction of gaseous emissions including hydrocarbons, CO and NOX.

The state of the art of double dome combustor apparatus is represented by a number of U.S. patents:

U.S. Pat. No. 4,903,492 issued to King on Sep. 7, 1988 discloses a dilution air dispensing apparatus for a double dome combustor with dilution air dispensing holes that are staggered on the opposite walls of the centerbody. The wakes on the downstream side of the jets provide avenues of access for the deflected combustion gases to continue their travel across the combustor and into the regions downstream of the opposite domes. The gases then mix with the remaining undeflected gases from the domes and with the spent dilution air before reaching a combustor exit plane. This dilution method is common to essentially all combustors on the inner and outer shells.

U.S. Pat. No. 4,173,118 issued to Kawaguchi on Nov. 6, 1979 discloses a fuel combustion cylinder having a double concentric combustion cylinder which includes a rich mixture zone, a lean mixture zone and a dilution zone.

U.S. Pat. No. 3,306,333 issued to Mock on Feb. 28, 1967; Mock patent is directed to a combustor of the flame tube type and toroidal or smoke ring type of gas circulation in the primary zone.

U.S. Pat. No. 4,237,694 issued to Wood et al on Dec. 9, 1980 describes a combustor for a gas turbine engine which has a central duct partially surrounded by an annular duct. Each duct has an array of swirl vanes at their upstream ends and fuel inlet apertures are located downstream of the respective arrays of swirl vanes.

U.S. Pat. Nos. 3,606,421 issued to Goddard on Aug. 12, 1952, 3,820,324 issued to Grindley et al on Jun. 28, 1974, 3,851,465 issued to Verdouw on Dec. 3, 1974, 4,113,425 issued to von Linde et al on Sep. 12, 1978, and 4,195,475 issued to Verdouw on Apr. 1, 1980 provide additional background information on the state of the field of art.

U.S. Pat. No. 3,720,058 issued to Collinson et al discloses a combustor with three annular sets of injectors.

U.S. Pat. No. 4,194,358 issued to Stenger discloses a double annular combustor having means to separate the gases.

U.S. Pat. No. 4,215,536 issued to Rudolph discloses a mixer apparatus for mixing core and fan streams.

U.S. Pat. No. 4,246,758 issued to Caruel et al discloses a double annular combustor with an internal wall between the combustors.

U.S. Pat. No. 4,305,255 discloses a double annular combustor without an internal wall.

As pointed out in King U.S. Pat. No. 4,903,492, combustor length of advanced engines were being reduced for the purpose of reducing overall engine length and weight. The double dome combustor served as a means for reducing combustor length while meeting other important design criteria; however, in short double dome combustor designs, some amount of centerbody dilution air is needed. This additional centerbody dilution air, along with the dilution air from the combustor inner and outer walls, provides cooling to the center portion of the combustor exit stream, and is also necessary to achieve the desired temperature gradient variation (profile shape) across the combustor exit stream. The circumferential variations in temperature must also be limited; however, this condition is particularly difficult due to the shortness of the combustor and the very limited length which is available for mixing between the locations where dilution air is admitted and the combustor exit.

In accordance with King, some of the described problems were alleviated in the double dome combustor by inclining a pair of dilution jets in a slightly downstream direction from the dome and staggering the dilution holes located on opposite walls of the centerbody to produce what King described as a powerful aerodynamic mixer. The blockage effect created by the inclined jets caused a portion of the approaching combustion gases to accelerate and to turn toward the regions downstream of the adjacent or opposite domes.

The present invention is an improvement over the prior art double dome combustors and over the King apparatus in that it provides a daisy-type mixer downstream of the domes to increase the mixing perimeter of the region between the two combustion areas and to provide complete mixing of the gases before reaching the exit plane of the combustor, at low pressure loss. Daisy mixers are very efficient in accomplishing lateral mixing of streams of unequal temperature at expenditure of low pressure loss. They require less pressure drop than the typical dilution jets, and hence the efficiency of the engine in enhanced.

SUMMARY OF THE INVENTION

The present invention provides a single shell, double dome combustor design configuration with the intermediate dividing wall between the two annuli removed, thereby reducing weight and cost, and improving durability. An annularly disposed, radial daisy type mixer is positioned between the domes to provide mixing of air and combustor gases prior to the exiting of the gases from the combustor to the turbine vanes. One of the issues relative to the elimination of the intermediate wall is that there will be lateral aerodynamic communication between the inner and outer arrays of annular swirlers, which when fueled in varying proportion, will provide for an uncontrolled leaning or enriching effect. Concurrently there would be circumferential aerodynamic communication between adjacent swirlers. The intermediate wall formed by the mixer exit air serves to separate the two annuli insofar as control of local annulus stoichiometry is concerned. In accordance with the present invention a daisy mixer is utilized downstream of the domes to provide effective, low pressure loss mixing at a controlled axial rate. The daisy type mixer used in accordance with this invention creates effective cross-flow barriers to avoid uncontrolled fuel/air ratio transfer between the inner and outer annuli, and thereby allows a concentric and controlled axial air admission in conjunction with the individual swirlers.

OBJECTS OF THE INVENTION

It is one object of the present invention to provide an improved dilution air dispensing apparatus.

It is another object of the invention to provide an improved dilution air dispensing apparatus wherein the mixing of adjacent streams of combustion gas from a double dome combustor is enhanced.

Yet another object of this invention is to provide an improved dilution air dispensing apparatus wherein the mixing of adjacent streams of combustion gas from a double dome combustor is accomplished by a daisy type mixer.

It is an object of the present invention to provide an improved dilution air dispensing apparatus comprising mixer which provides an enlarged mixing perimeter between adjacent domes and adjacent swirlers by inserting such surfaces axially and radially into the gas streams from such domes.

These and other advantages, objects and features of the invention will become more apparent after considering the following description taken in conjunction with the illustrative embodiment in the accompanying drawings.

DETAILED DESCRIPTION OF THE PREFERRED EMBODIMENT

Figure 1:
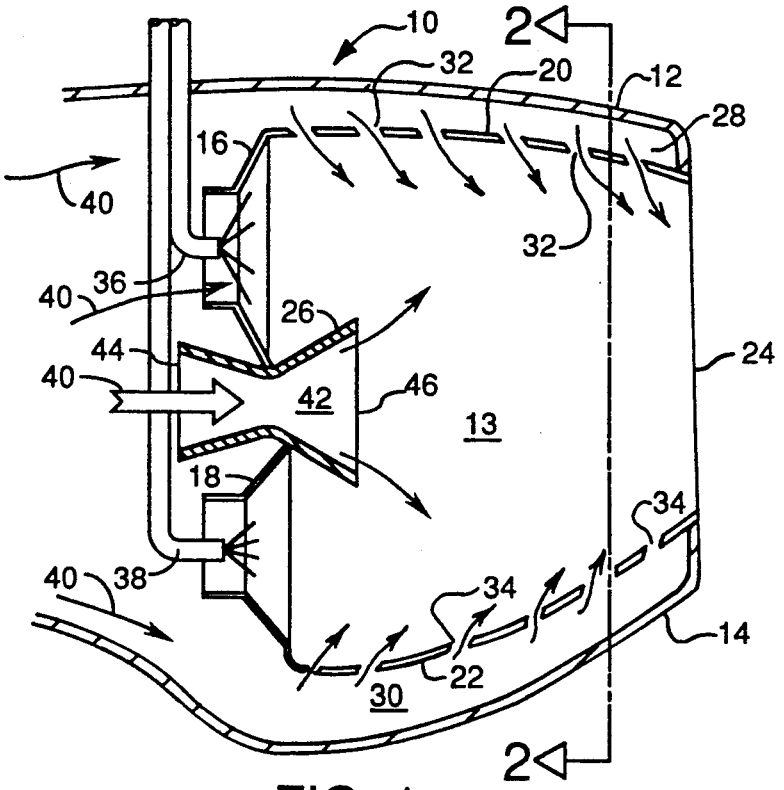
FIG. 1 is a cross-sectional view of a double dome combustor utilizing a daisy type mixer in accordance with the present invention.

A cross-sectional view of a double dome combustor 10 is shown in FIG. 1. The combustor 10 is comprised of an outer annular shell 12 and a concentric inner annular shell 14 which together form an annular housing for the double dome combustor 13. The double dome combustor 13 comprises two concentric single dome combustors with the common wall between the two domes omitted. Without a common wall means must be provided, to properly maintain the mixtures of the combustion gases and the dilution air.

Figure 2:
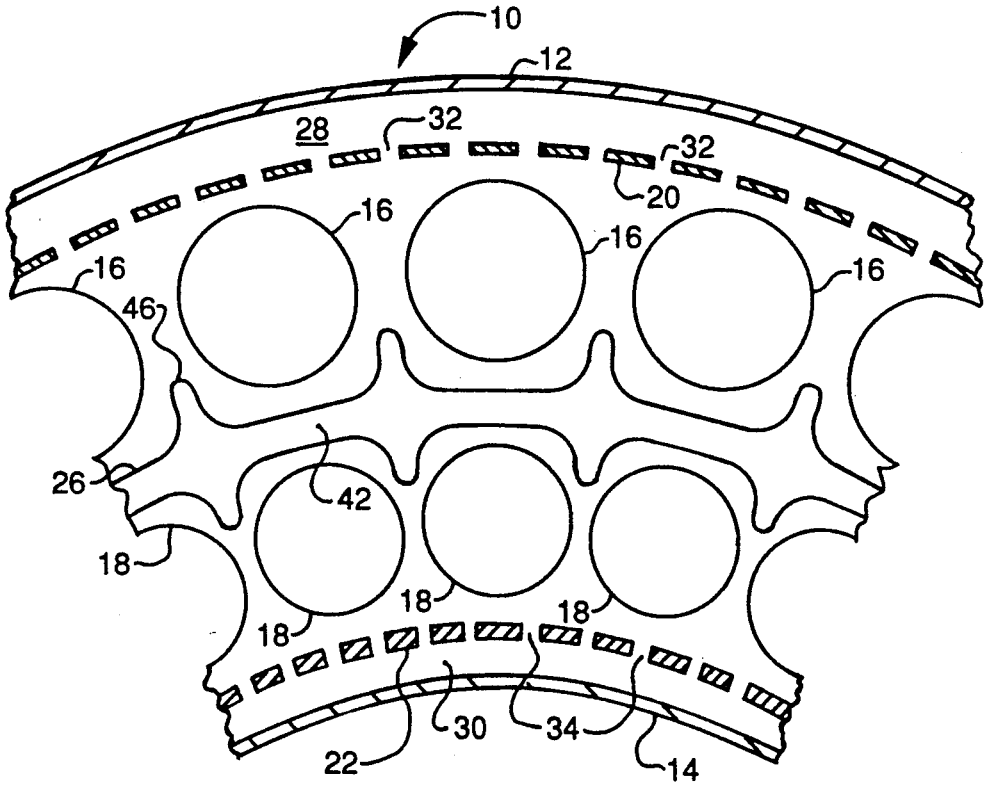
FIG. 2 is a sectional view taken along the line 2—2 of FIG. 1.

As shown in FIG. 1, The double dome combustor 13 comprises a first (or outer) array of swirlers 16 (see FIG. 2) and a second (or inner) concentric annular array of swirlers 18 which merge into an outer annular wall 20 and an inner annular wall 22 and blend to a common exit opening 24. The swirlers 16 are vortex forming vanes which mix primary combustion air with the fuel from the fuel injector which is mounted on the axis.

What would have been the double walls between the inner and outer domes is eliminated, and in its place is mounted an annular daisy type mixer 26 with radial mixer elements between respective domes. The space 28 between the walls 12 and 20, and the space 30 between the walls 14 and 22 provide passages for the flow of compressor air to the chamber 13 through perforations or slots 32 and 34, respectively.

The operation and the details of construction of a prior daisy type mixer are disclosed in a prior Vdoviak et al, U.S. Pat. No. 3,750,402. The daisy type mixer 26 provides an annular flow path 44 with a flared input opening at 44 and a daisy shaped output opening at 46. Compressor air, indicated by the arrows 40 is supplied to the passages 28 and 30, to the inlets to each of the domes and to the flared inlets 44 of the mixers 26. Air entering the domes is mixed with fuel exiting the fuel nozzles 36 and 38 to support combustion. Air entering the passageways 28 and 30 enters the combustor chamber 13 through the slots 32 and 34 to provide dilution, mixing and cooling of the hot combustion gases. The cross section of the daisy mixer 26 serves to increase the mixing perimeter of the region between the combustors and the surrounding air stream, and therefore, the air entering the inlet 44 of the daisy mixer 26 travels an elongated path over a large mixing perimeter and exits into the separate gas streams of the domes 16 and 18 respectively. This results in providing some of the gas separation of the two sets of domes while providing dilution and cooling for both. Thus the daisy mixer 26 provides, in essence the functional equivalent of two separate domes, while eliminating the disadvantages of weight, cost, and maintainability of such double dome combustors.

While there has been described what is now regarded as a preferred embodiment, it will be recognized that various modifications and adaptations will become apparent to persons skilled in the art. It is intended therefore that the scope of this invention be limited only by the appended claims as interpreted in the light of the prior art.

What is claimed is:

1. A double dome combustor comprising in combination:

an outer annular combustor wall;

an inner annular wall spaced from and concentric with said outer wall, the space between said inner and outer walls comprising a chamber for the combustion of fuels, said chamber having an inlet end and an outlet end;

an outer annular array of combustor swirlers and injectors comprising a dome in the inlet end of said chamber;

an inner annular array of combustor swirlers and injectors comprising a dome in the inlet end of said chamber, said inner array being spaced from and concentric with said outer array;

a daisy-type mixer in said inlet end intermediate said arrays, said mixer extending axially and radially into said chamber in the areas between each of said domes, said daisy-type mixer comprising an annulus disposed between the arrays, and having a flared outlet which extends axially and radially into the gas streams of adjacent domes in said inner and outer arrays;

means for supplying air to said chamber through said inlet end and through said mixer;

and a plurality of air inlet openings in said inner and outer walls, air from said inlet being supplied through said openings in said walls.

* * * * *

UNITED STATES PATENT AND TRADEMARK OFFICE

CERTIFICATE OF CORRECTION

PATENT NO. : 5,284,019

DATED : February 8, 1994

INVENTOR(S) : John W. Vdoviak

It is certified that error appears in the above-indentified patent and that said Letters Patent is hereby corrected as shown below:

On the title page, Item [54] Title of the Invention: "ANULAR" should read —ANNULAR—. Column 1, line 2, "ANULAR" should read —ANNULAR—.

Signed and Sealed this

Twelfth Day of July, 1994

Bruce Lehman

*Attest:*

BRUCE LEHMAN

*Attesting Officer*

*Commissioner of Patents and Trademarks*